US006607172B1

(12) United States Patent
Green et al.

(10) Patent No.: US 6,607,172 B1
(45) Date of Patent: Aug. 19, 2003

(54) MOUNTING BRACKET FOR SOLENOID VALVE

(75) Inventors: John Clarence Green, Sterling Heights, MI (US); Cathleen Grace Rutsey, Ferndale, MI (US); Rob Meilinger, Beverly Hills, MI (US); Stephen E. Stucky, Lake Orion, MI (US); Giuseppe Ganio-Mego, Royal Oak, MI (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 09/610,805

(22) Filed: Jul. 6, 2000

Related U.S. Application Data

(63) Continuation-in-part of application No. 09/266,650, filed on Mar. 11, 1999.

(51) Int. Cl.[7] ..... A47F 5/00
(52) U.S. Cl. ..... 248/309.1
(58) Field of Search ..... 248/67.5, 67.7, 248/74.3, 74.5, 309.1, 73, 74.1, 62, 60; 310/91; 335/202; 24/255 SL, 257, 457, 543, 339, 518

(56) References Cited

U.S. PATENT DOCUMENTS

| | | | | | |
|---|---|---|---|---|---|
| 3,163,391 | A | * | 12/1964 | Adams | 248/223 |
| 3,220,679 | A | * | 11/1965 | Larson | 248/71 |
| 3,273,839 | A | * | 9/1966 | Bennett | 248/73 |
| 3,460,788 | A | * | 8/1969 | Goldman | 248/74 |
| 3,867,055 | A | * | 2/1975 | Wooden | 403/373 |
| 4,076,197 | A | * | 2/1978 | Dochterman | 248/15 |
| 4,360,178 | A | * | 11/1982 | Senter et al. | 248/74 R |
| 4,502,653 | A | * | 3/1985 | Curtis, Jr. | 248/55 |
| 4,903,921 | A | * | 2/1990 | Logsdon | 248/74.5 |
| 4,958,792 | A | * | 9/1990 | Rinderer | 248/74.2 |
| 5,297,890 | A | * | 3/1994 | Commins | 403/398 |
| 5,593,132 | A | | 1/1997 | Hrytzak | |
| 5,839,703 | A | * | 11/1998 | Tesar | 248/65 |
| 6,010,099 | A | * | 1/2000 | Wertz et al. | 248/55 |
| 6,152,412 | A | * | 11/2000 | Basickes et al. | 248/317 |
| 6,182,646 | B1 | * | 2/2001 | Silberstein et al. | 123/568.26 |

FOREIGN PATENT DOCUMENTS

| | | |
|---|---|---|
| EP | 0 428 274 A1 | 5/1991 |
| EP | 0 900 931 A3 | 10/1999 |
| EP | 0 900 931 A2 | 10/1999 |

* cited by examiner

*Primary Examiner*—Leslie A. Braun
*Assistant Examiner*—A. Joseph Wujciak
(74) *Attorney, Agent, or Firm*—Artz & Artz, P.C.; Greg Dziegielewski, Esq.

(57) ABSTRACT

A mounting bracket mechanism and system for mounting a solenoid operated valve, such as an EGR valve, to a vehicle. A strap-type mounting bracket is positioned over the valve and secured to the engine or other vehicle component with a plurality of bolts or other fasteners. A curved recess or groove is provided in an engine component or surface, or a spacer member is positioned between the valve and the engine component or surface in order to maximize surface contact and thus heat transfer between the valve and the vehicle. Spring tab members can be positioned on the mounting bracket in order to minimize vibration of the valve in the vehicle and more securely fix it in place. The mounting bracket, spacer member, and valve can be assembled together as a modular preassembly for mounting to the engine.

9 Claims, 5 Drawing Sheets

MOUNTING BRACKET FOR SOLENOID VALVE

CROSS-REFERENCE TO RELATED APPLICATION

This is a continuation-in-part of U.S. patent application Ser. No. 09/266,650 filed on Mar. 11, 1999.

TECHNICAL FIELD

The present invention relates to mounting brackets for solenoid operated valves, and more particularly for mounting brackets for maximizing heat transfer and minimizing vibrations relative to solenoid operated exhaust gas recirculation (EGR) valves.

BACKGROUND OF THE INVENTION

Solenoid operated exhaust gas recirculation (EGR) valves are in common use today in vehicles with internal combustion engines. The EGR valves permit a certain amount of exhaust gases to be recirculated into the combustion system of the engines in order to improve fuel economy and to reduce undesirable emissions. The solenoid operated EGR valves are frequently robust in structure and as a result generate significant thermal energy which can affect the accuracy and performance of the solenoid valve mechanism. Also, the EGR valves need to be mounted securely in the vehicle so that vibration and other forces that they are commonly exposed to will not affect the mounting of the valves in the vehicle or affect the operation thereof. Vibrations in an EGR valve can cause noise and lead to vibrations in other components of the vehicle—both of which are undesirable.

A need exists for a mounting system for solenoid operated valves which maximizes the heat transfer from the valves and also reduces the possibility of undesirable vibrations.

SUMMARY OF THE INVENTION

It is an object of the present invention to provide an improved mounting system for solenoid operated valves and other components in vehicles. It is also an object of the present invention to provide a mounting mechanism for an EGR valve which maximizes heat transfer from the EGR valve to the vehicle.

It is a further object of the present invention to provide a mounting system for an EGR valve or other solenoid operated components in the vehicle which minimizes the vibration of that valve or component.

These and other objects, purposes and advantages of the present invention will become apparent from the following description of the invention when viewed in accordance with the attached drawings and the appended claims.

In accordance with the present invention, a mounting bracket mechanism and system are provided which maximizes heat transfer from a solenoid operated valve to the engine or other remote location and also minimizes vibration normally experienced in mounting brackets and systems for EGR valves and other solenoid operated components. In one embodiment of the present invention, a formed strap-type bracket member is utilized which fits over the EGR valve and holds it firmly in place against a cylinder head, intake manifold, or a location in the engine or vehicle engine compartment. The bracket is formed to fit closely over the solenoid motor portion of the EGR valve and provide either continuous contact or point contact along the surface of the EGR valve in order to facilitate heat transfer from the motor and EGR valve to the bracket member and thus to the vehicle.

The bracket member can be used in combination with a curved or formed spacer member (curved cradle), particularly made of aluminum material, that is positioned against the cylinder head, intake manifold, or the like. Alternatively, a groove or recess can be formed in the engine component in order to increase surface contact with the EGR valve and facilitate heat transfer from the valve to the engine component.

The bracket member is secured to the engine component by at least two fasteners, such as bolts or other conventional fasteners. When a spacer member is utilized, the bolts which pass through the bracket member can also, under certain circumstances, pass through the spacer member. The spacer member or curved cradle is typically designed for maximum contact with the mounting surface and for close proximity to the surface of the EGR valve. The bracket, fastener members, and formed groove or spacer member securely hold the EGR valve in place and reduce vibration of the EGR valve in the vehicle.

In another embodiment of the invention, the bracket member includes spring loading tabs that secure the EGR valve in place preferably with a four-point "box" pattern contact in combination with a spacer member or curved groove. Where a spacer member is utilized, locking tabs provided on the bracket member snap into mating grooves in the spacer member allowing the EGR valve, together with the bracket and spacer member, to be preassembled for ease of assembly in the vehicle.

BRIEF DESCRIPTION OF THE DRAWINGS

For a more complete understanding of this invention, reference should now be had to the embodiments illustrated in greater detail in the accompanying drawings described below by way of examples of the invention. In the drawings.

DESCRIPTION OF THE PREFERRED EMBODIMENT(S)

Figure 1:
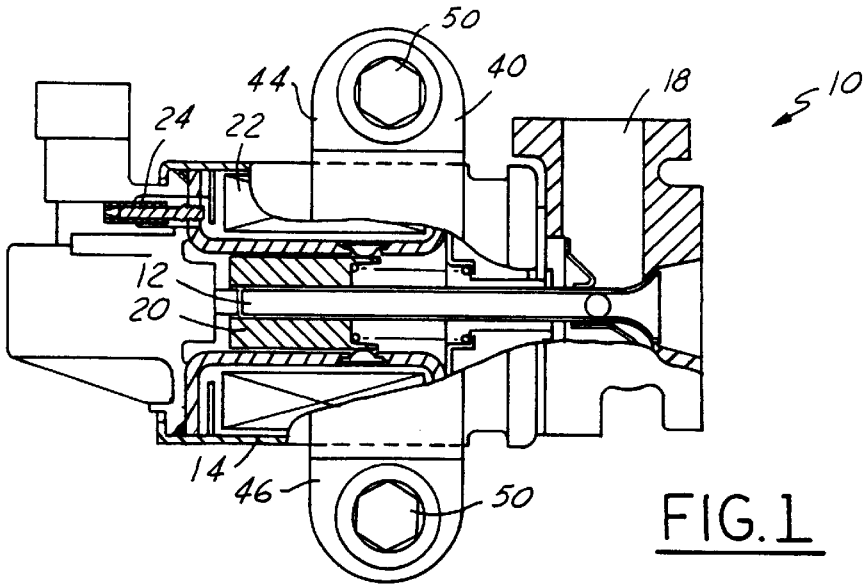
FIGS. 1 and 2 comprise side elevational and end elevational views, respectively, of a mounting bracket mechanism in use in accordance with the present invention.
Figure 2:
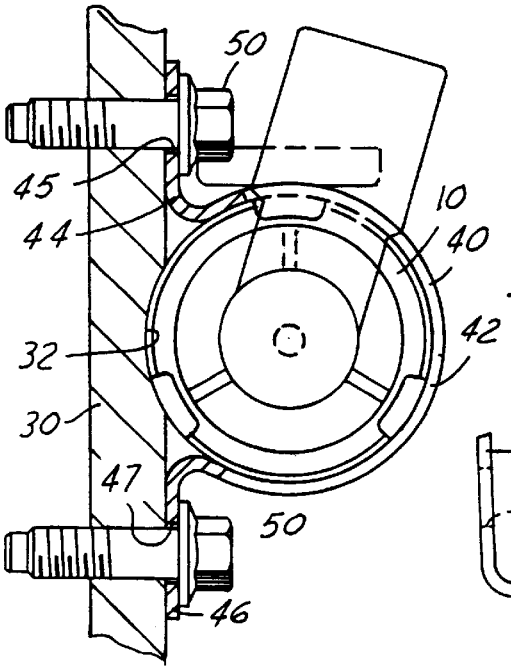

FIGS. 1 and 2 illustrate a first embodiment of the invention when used with a solenoid operated exhaust gas recirculation (EGR) valve mechanism. In this regard, it is understood that the present inventive mounting bracket system can be used with any component of a vehicle or other device in which heat transfer is necessary from the device to a mounting surface and/or where vibration needs to be minimized. Thus, although the present invention will be described in accordance with its preferred use relative to solenoid operated EGR valves, it is to be understood that the present invention is not to be limited to use with EGR valves and can be used with other mechanisms and other components that would be known and obvious to persons of ordinary skill in the art.

In the drawings, the solenoid operated EGR valve, which is depicted schematically, is generally referred to by the reference numeral 10. In the EGR valve 10, a valve stem member 12 is positioned in a housing 14 and used to open and close a valve mechanism 16. Exhaust gases are passed through the chamber 18 in the EGR valve and the valve mechanism 16 is operated to selectively introduce exhaust gases to the combustion system of the engine.

The valve stem member 12 is attached to a moveable armature member 20 in the EGR valve. The armature 20 moves longitudinally axially in the EGR valve mechanism 10 in accordance with activation of the coil 22 which is positioned around it. The coil and armature are part of a solenoid mechanism which is powered through electrical contacts in conduit 24.

Figure 3A:
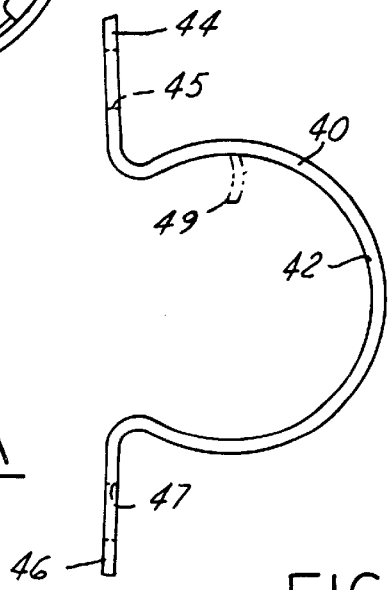
FIGS. 3A and 3B are side and top elevational views of the mounting bracket member shown in FIGS. 1–2.
Figure 3B:
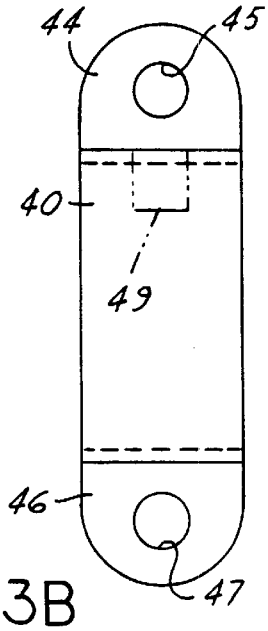

The EGR valve is secured to the vehicle 30 by mounting bracket 40. The bracket 40 is shown more clearly in FIGS. 3A and 3B. As indicated, the bracket member 40 has generally an "Omega" shape with a curved section 42 and a pair of flat end flange members 44 and 46. The end flanges have openings 45 and 47, respectively, for securing the bracket to the vehicle 30 by fastener members, such as bolts 50 shown in FIGS. 1 and 2.

The portion of the vehicle or other engine portion 30 in which mounting bracket and EGR valve are secured can be a cylinder head, intake manifold, or other available component or portion of the vehicle.

The mounting bracket 40 is positioned tightly around the outer surface of the solenoid or motor portion of the EGR valve and acts as a heat sink to siphon heat from the EGR valve and pass it on or distribute it to the engine component 30. For this purpose, a bracket member 40 is preferably made from an aluminum or steel material which have high heat transfer capabilities. The mounting bracket 40 can also be made from an aluminum alloy.

As shown in FIG. 2, the engine component 30 is provided with a curved groove or recess 32 in a surface in order to more closely mate with the curved outer surface of the EGR valve. This allows maximum heat transfer from the EGR valve to the engine component 30 which typically is subjected to cooling in one form or another.

The mounting bracket 40 can be coated with a zinc-chromate or zinc-iron coating for corrosion protection. The coating can be electrodeposited on the surface of the bracket, or the coating can be applied in a zinc-chromate conversion coating process. Both of these coating processes are well known in the art.

Figure 4:
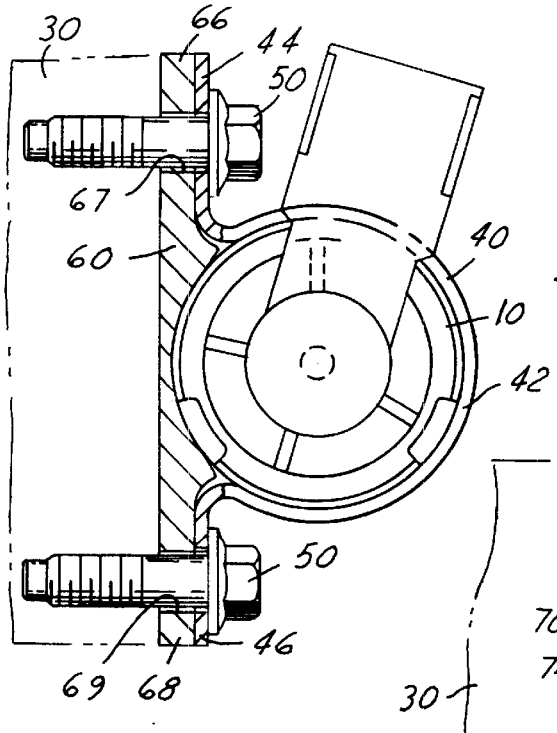
FIGS. 4 and 5 illustrate additional embodiments of the invention utilizing spacer members with the bracket members.

FIG. 4 illustrates an alternate embodiment of the invention in which a spacer member 60 is utilized. The spacer member 60 is positioned between the EGR valve 10 and the engine component 30 and used to facilitate heat transfer from the EGR valve to the engine component 30. In this regard, preferably the spacer member 60 is made from an aluminum material.

Figure 6A:
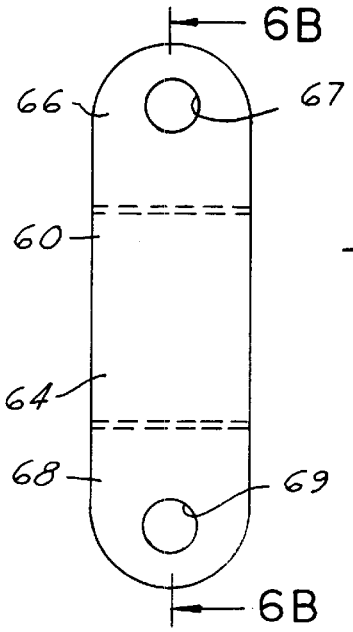
FIGS. 6A and 6B are side and top elevational views of a spacer member in accordance with the present invention.
Figure 6B:
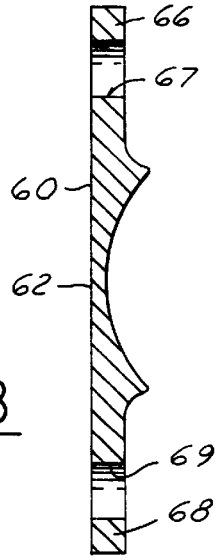

The spacer member 60 by itself is shown in FIGS. 6A and 6B. The spacer member 60 includes a central portion 62 with a curved recess 64 (a/k/a "curved cradle") therein and a pair of mounting flanges 66 and 68. Openings 67 and 69 are provided in the flanges 66 and 68, respectively, and are used to allow bolts 50 or other fasteners to pass through in order to attach the mounting bracket to the engine or vehicle component 30.

Figure 5:
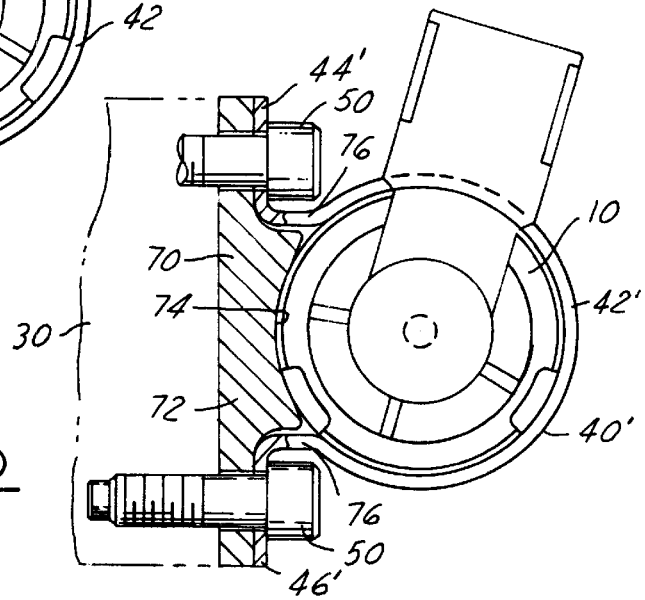

An alternate embodiment of the invention utilizing a spacer member is shown in FIG. 5. The spacer member 70 is utilized to position the EGR valve member 10 from the surface when the mounting component or surface cannot be readily machined. For this purpose, a raised center section 72 is provided in which the recess or cradle 74 is provided. Also, for the embodiment shown in FIG. 5, the bracket member 40' has a slightly different shape. In particular, the bracket member 40' has raised extender portions 76 positioned between the curved center portion 42' and the flat end flanges 44' and 46'.

Different configurations affect the shape of the groove or cradle in the aluminum spacer or vehicle component. It can be designed for maximum contact with the outer surface of the EGR valve in order to maximize heat transfer from both the motor and gas passage areas of the valve. It also can be designed with two-point contact to minimize vibration issues.

In order to prevent the EGR valve from moving axially or longitudinally relative to the bracket members 40 and 40', a tab member is preferably provided on the bracket that fits within a notch in the housing of the EGR valve. An example of such a tab member is shown in phantom in FIGS. 3A and 3B and designated by the reference numeral 49.

Figure 7:
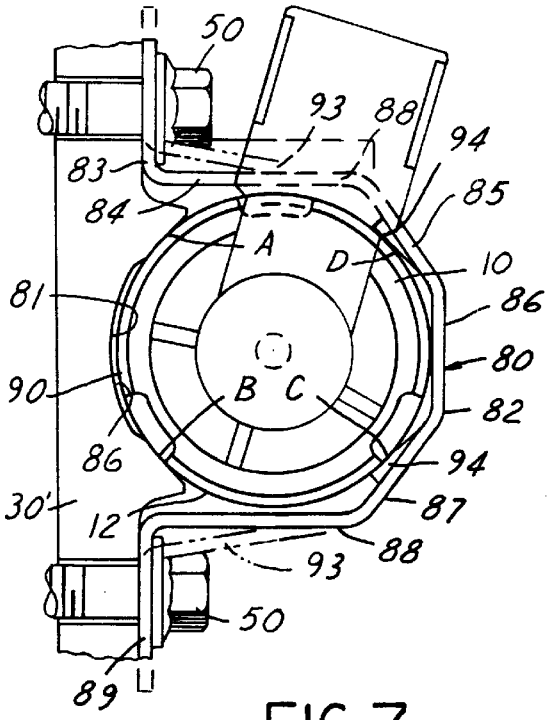
FIG. 7 illustrates an alternate embodiment of the invention.
Figure 8:
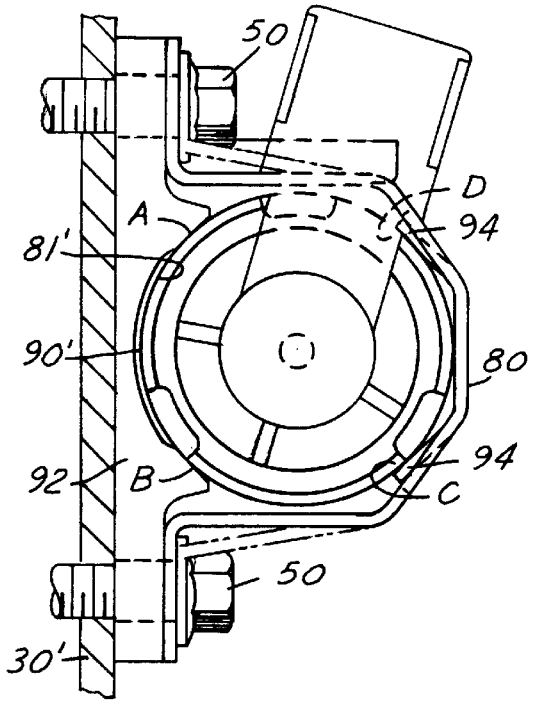
FIG. 8 illustrates an alternate embodiment of the invention in which a spacer member is utilized.
Figure 9A:
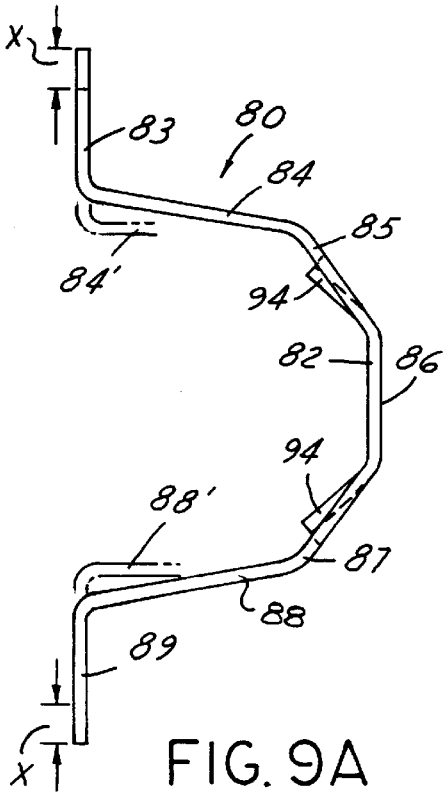
FIGS. 9A and 9B are side and top elevational views of the mounting bracket member shown in FIGS. 7 and 8.
Figure 9B:
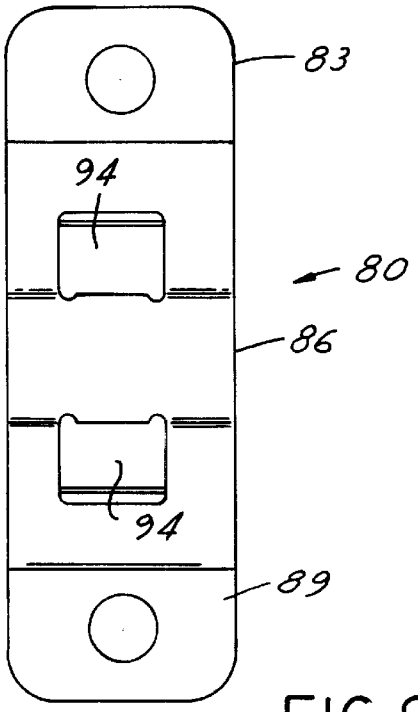
Figure 10:
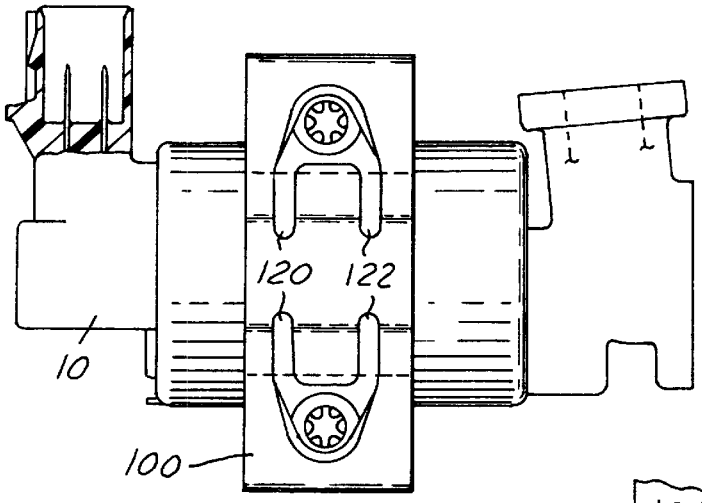
FIGS. 10 and 11 illustrate still another embodiment of the present invention.
Figure 11:
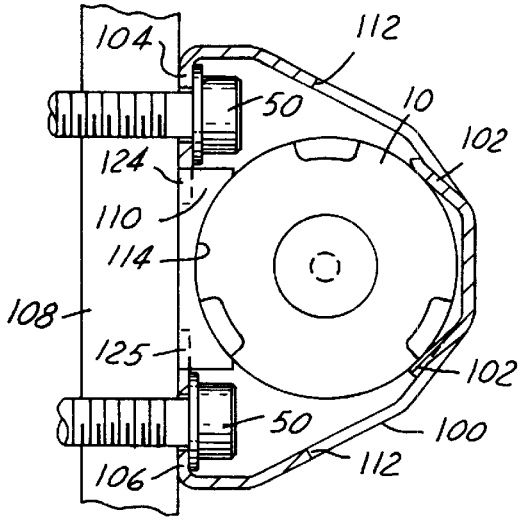

Other alternate embodiments of the present invention are shown in FIGS. 7 and 8. These embodiments utilize a mounting bracket member 80 which secures the EGR valve 10 in place. The mounting bracket 80 by itself is shown in FIGS. 9A and 9B. The primary difference between FIGS. 7 and 8 is that the mounting bracket system shown in FIG. 8 utilizes a spacer member 92, while the embodiment shown in FIG. 7 is mounted directly on the vehicle 30'.

In FIG. 7, the EGR valve is positioned in a cradle or groove in an engine component 30' or other surface similar to that described above with respect to FIG. 2. The bracket member 80, however, has a strap-type holder member 82 which consists of a plurality of plane surfaces 83, 84, 85, 86, 87, 88 and 89.

The mounting bracket 80 in combination with the groove or recess 81 in the engine component 84 provide four points of contact with the EGR valve member 10. These contact points are indicated by the letters A, B, C, and D in FIG. 7. For this purpose, the recess or groove 81 has a curve which does not identically conform to the outer curvature of the EGR valve, but leaves a space 90 in-between contact points A and B.

The bracket member 80 is attached to the vehicle or component 30' by bolts 50 or other conventional fasteners in the same manner as the bracket members discussed above. Spring loaded bracket tabs 94 contact the housing 12 of the EGR valve 10 in order to provide the appropriate points of contact and heat transfer.

Also, with the embodiment shown in FIG. 7, strengthening gussets 93 can be provided on the bracket member 80. The gussets strengthen the bracket member and also allow more secure fixation of the EGR valve 10 to the engine. The bracket sections 84 and 88 also are bent slightly outwardly, as shown in solid lines in FIG. 9A, in the relaxed positions, and then sprung inwardly to the positions 84' and 88' when installed and fastened in place by fasteners 50. In this regard, the ends of flange members 83 and 89 move distances "X"

when the bracket is installed over the EGR valve. This adds an additional biasing force on the valve to assist in holding it firmly in place.

In FIG. 8, the same bracket member 80 as set forth above with reference to FIG. 7 is utilized in a mounting system utilizing a spacer member 92. The mounting bracket member 80 includes the same features as discussed above and is utilized in a similar manner to connect the EGR valve to the vehicle component 84.

The two spring loading tabs 94 that secure the EGR valve in position with the four point contact (or "box" pattern) provide optimum retention of the valve under vibration conditions. The contact with the bracket and engine component also allows for satisfactory heat transfer from the EGR valve to the bracket and engine component.

A further embodiment of the invention is shown in FIGS. 10–14. In this embodiment, the EGR valve 10 is positioned in a bracket member 100 together with a spacer member 110. The three members are preassembled together prior to mounting the EGR valve in the vehicle. The bracket member 100 has a pair of spring tab members 102 which provide point contact with the EGR valve similar to that manner described above with reference to FIGS. 7 and 8. The flange members 104 and 106 which are used to secure the bracket member 102 to the vehicle component 108, are turned inwardly rather than outwardly as shown in the embodiments described above.

With this embodiment, the ends of the bracket flanges 104 and 106 each have a pair of locator tabs 120 and 122. The locator tabs are adapted to be positioned in mating socket members 124 and 125 in the spacer member 110. The spacer member 110 also has a groove or cradle 114 which is adapted to mate with the external surface of the EGR valve 10 and provide maximum heat transfer contact.

Openings 112 are provided in both sides of the mounting bracket 100 in order to provide access to the bolts or other fasteners 50 which are used to attach the EGR valve and mounting bracket to the engine component 108.

When the mounting bracket 100 is secured to the spacer member 110 with the mounting sockets 124 and 125 in combination with the mounting tabs 120 and 122, and the subassembly of the EGR valve 10 in combination therewith can be supplied as a preassembled modular component to the assembly line for assembly into the vehicle. In this regard, due to the shape and material of the mounting bracket 100, the tab members 120 and 122 snap into and securely hold the spacer member 100 in position. The assembly of parts are then shipped to the vehicle assembly facility ready to mount to the engine with a drive tool access through the openings 112 in the bracket member.

Figure 12:
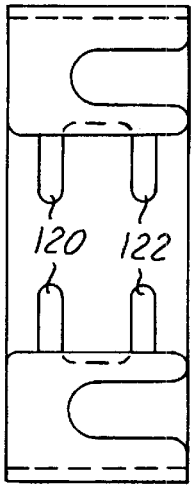
FIGS. 12, 13 and 14 are bottom, side and top views, respectively, of the mounting bracket used with the embodiment shown in FIGS. 10 and 11.
Figure 13:
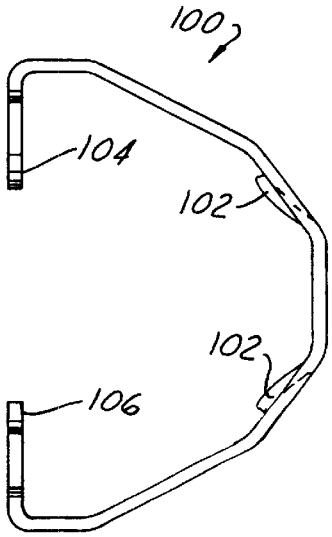
Figure 14:
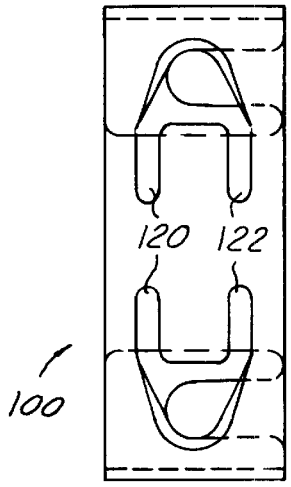

FIG. 12 is a bottom view of the mounting bracket 100 showing the slots for assembly. FIGS. 13 and 14 depict the bracket member 100 by itself.

Figure 15:
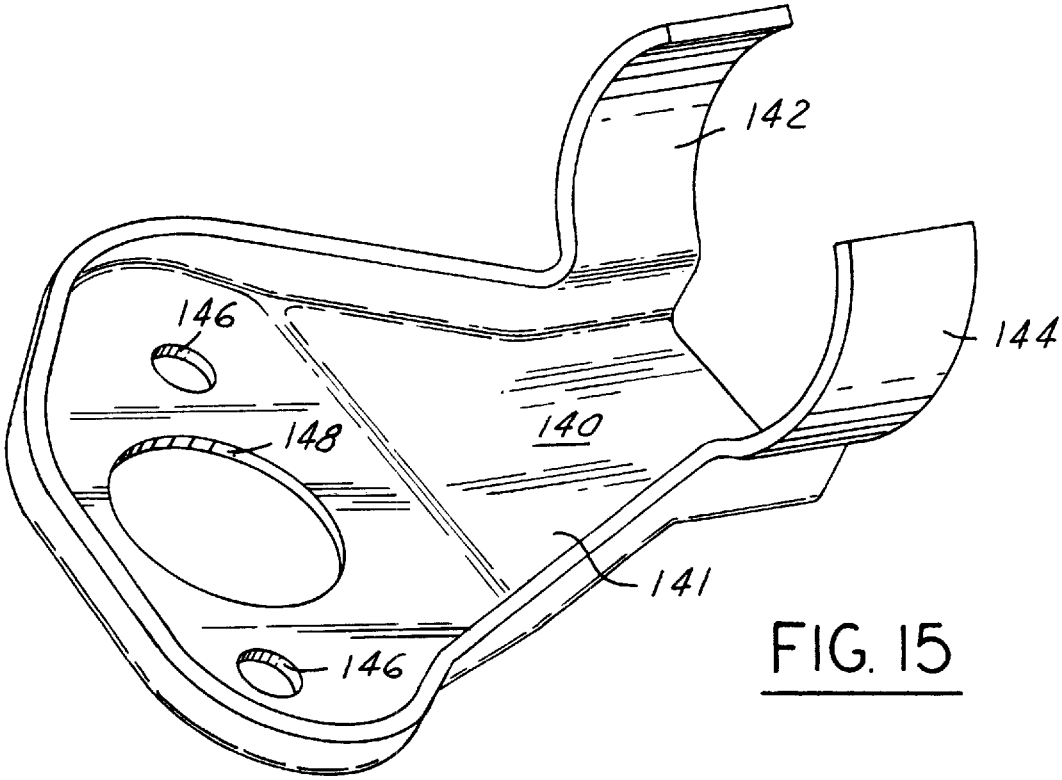
FIG. 15 illustrates another embodiment of the invention.

Another alternative embodiment of the invention is shown in FIG. 15. The bracket member 140 has a body member 141 and pair of arm members 142 and 144. The solenoid member or EGR valve is held in place by the arm members 142 and 144. The bracket member 140 is attached to the mounting surface or the like by fasteners positioned through openings 146 in the body member 141. Opening 148 allows communication with the internal passageways in the valve member.

While the invention has been described in connection with one or more embodiments, it is to be understood that the specific mechanisms and techniques which have been described are merely illustrative of the principles of the invention. Numerous modifications may be made to the methods and apparatus described without departing from the spirit and scope of the invention as defined by the appended claims.

What is claimed is:

1. A preassembled modular system comprising a bracket member, a spacer member and a vehicle component device for securing said device to said vehicle, said bracket member having a body portion, a pair of mounting flanges, and a pair of spring tab members, said mounting flanges having first connecting means thereon and openings for entry of fastening members, said body portion configured to closely fit around a first portion of said device and having openings for access to fastening members used to secure said modular system to a vehicle, said pair of spring tab members contacting said device and securely holding it in place, said spacer member having a recessed groove and a second connecting means thereon, said recessed groove configured to closely fit around a second portion of said device, wherein when said device is positioned in said recessed groove, when said body portion is positioned adjacent said first portion of said device, and said first and second connecting means are interlocked together, a preassembled modular mechanism is assembled.

2. The mounting bracket for securing a device to a vehicle in claim 1 wherein said bracket member and spacer member are both made of an aluminum material.

3. A mounting bracket for securing a device to a vehicle, said bracket comprising a body portion and a spacer member, said body portion comprising a plurality of planar sections connected together, a pair of spring tab members directly inwardly for contact with said device, and a pair of mounting flange members and said spacer member being positioned between the device and a vehicle.

4. The mounting bracket for securing a device to a vehicle in claim 3 further comprising a locating tab member on said body portion for preventing movement of said device in a longitudinal direction relative to said mounting bracket.

5. The mounting bracket for securing a device to a vehicle in claim 3 wherein said flange members are bent inwardly toward one another and include mating members thereon for mating with said spacer member.

6. The mounting bracket for securing a device to a vehicle in claim 3 wherein said spacer member has a recessed groove therein for closely fitting a portion of the external surface of a device.

7. The mounting bracket for securing a device to a vehicle in claim 3 wherein said body member is spring biased in position by fastener members when said bracket member is secured to a vehicle and secures a device to the vehicle.

8. The mounting bracket for securing a device to a vehicle in claim 3 wherein said mounting flange members are interconnected with said spacer member.

9. The mounting bracket for securing a device to a vehicle in claim 8 wherein said body portion has openings thereon for access to fastener members used to secure said member and bracket member to a vehicle.

* * * * *